US006620459B2

(12) United States Patent
Colvin et al.

(10) Patent No.: US 6,620,459 B2
(45) Date of Patent: Sep. 16, 2003

(54) RESIN-IMPREGNATED SUBSTRATE, METHOD OF MANUFACTURE AND SYSTEM THEREFOR

(75) Inventors: John Colvin, The Woodlands, TX (US); Charles Vignal, The Woodlands, TX (US); Philippe Edouard Tissot, Corpus Christi, TX (US); Larry Raymond Crowe, Conroe, TX (US)

(73) Assignee: Houston Advanced Research Center, The Woodlands, TX (US)

( * ) Notice: Subject to any disclaimer, the term of this patent is extended or adjusted under 35 U.S.C. 154(b) by 61 days.

(21) Appl. No.: 09/781,560

(22) Filed: Feb. 13, 2001

(65) Prior Publication Data

US 2002/0155223 A1 Oct. 24, 2002

(51) Int. Cl.[7] ..... B05D 3/04

(52) U.S. Cl. ..... 427/303; 427/302; 427/324; 427/385.5; 427/396

(58) Field of Search ..... 427/301, 302, 427/303, 324, 384, 385.5, 396

(56) References Cited

U.S. PATENT DOCUMENTS

| | | | | |
|---|---|---|---|---|
| 2,897,094 A | | 7/1959 | Hayes et al. | 117/62 |
| 3,485,575 A | | 12/1969 | Christian et al. | 8/116.2 |
| 3,492,081 A | | 1/1970 | Morak | 8/116.2 |
| 3,953,169 A | | 4/1976 | Igarashi et al. | 8/192 |
| 4,029,846 A | | 6/1977 | Decker et al. | 428/423 |
| 4,137,046 A | | 1/1979 | Koike et al. | 8/192 |
| 4,396,647 A | | 8/1983 | Linden | 427/340 |
| 4,587,141 A | | 5/1986 | Cooley | 427/379 |
| 4,670,100 A | | 6/1987 | Henning et al. | 162/135 |
| 4,857,252 A | | 8/1989 | Melchior et al. | 264/118 |
| 5,008,359 A | | 4/1991 | Hunter | 527/103 |
| 5,151,238 A | | 9/1992 | Earl et al. | 264/136 |
| 5,188,785 A | | 2/1993 | Bauer et al. | 264/115 |
| 5,332,458 A | | 7/1994 | Wallick | 156/210 |
| 5,346,574 A | | 9/1994 | Tamura et al. | 156/257 |
| 5,456,964 A | | 10/1995 | Tamura et al. | 428/105 |
| 5,482,781 A | | 1/1996 | Wittekind et al. | 428/537.5 |
| 5,503,714 A | | 4/1996 | Reiners et al. | 162/164.6 |
| 5,605,605 A | | 2/1997 | Coleman et al. | 162/135 |
| 5,679,407 A | | 10/1997 | Mansikkamaki et al. | 427/297 |
| 5,750,201 A | | 5/1998 | Phanopoulos et al. | 427/375 |
| 5,908,496 A | | 6/1999 | Singule et al. | 106/271 |
| 6,123,795 A | * | 9/2000 | Symons | 156/222 |
| 6,146,710 A | * | 11/2000 | Symons | 427/185 |

FOREIGN PATENT DOCUMENTS

| | | |
|---|---|---|
| WO | WO98/56991 | 6/1998 |
| WO | WO98/56989 | 12/1998 |

* cited by examiner

*Primary Examiner*—Nathan M. Nutter
*Assistant Examiner*—Thao Tran
(74) *Attorney, Agent, or Firm*—Wong, Cabello, Lutsch, Rutherford & Brucculeri, L.L.P.

(57) ABSTRACT

The disclosed invention relates to polyisocyanate-impregnated lignocellulosic substrates having improved strength, water resistance and appearance, and also to methods and systems for producing such substrates. The polyisocyanate-impregnated lignocellulosic substrate are produced by impregnating a lignocellulosic substrate with an isocyanate resin, followed by polymerization of the isocyanate resin by applying a heated liquid to the impregnated substrate.

21 Claims, 2 Drawing Sheets

RESIN-IMPREGNATED SUBSTRATE, METHOD OF MANUFACTURE AND SYSTEM THEREFOR

FIELD OF THE INVENTION

The disclosed invention relates to polyisocyanate-impregnated lignocellulosic substrates, and methods and systems for producing them. More particularly, the invention is a method of impregnating medium and high density fiberboard with isocyanate resin and then polymerizing the resin through the application of heat and/or a liquid catalyst, such that the polymerized board is able to withstand moisture and displays a resistance to fungus and insects. The polymerized board may be used for doors, door parts and the like.

BACKGROUND

Hollow core doors are used principally in interior applications. A hollow core door may be a flush door, that is one flat or planar, with or without molded surfaces, on both major surfaces. The skins used for flush doors are relatively inexpensive, but they do not provide the aesthetic features and physical properties sometimes required by consumers. Hollow core doors manufactured from medium and high density fiberboard skins are not typically used in exterior applications, due to problems arising on account of moisture absorption and the resultant swelling of the cellulosic fibers.

Many hollow core doors are made from door skins, rails and stiles formed from wood and/or composite materials. These wood composite materials may include particle board, flake board, hard board and medium density fiber board ("MDF"). The wood composites utilize a resin binder, which frequently is a thermal setting resin, in order to maintain the wood fibers forming the composite in solid form. The wood composites are not moisture impervious, so doors utilizing such composites may not be suitable for exterior applications. Should the composite material absorb moisture, whether in liquid or gas form, then the door components may swell and the door become distorted. Fiberglass and steel doors do not have the same moisture absorbing tendency, and hence are more frequently used for exterior applications.

The use of urea-formaldehyde or phenol-formaldehyde resins as binder material in wood composites is known in the art. After polymerization of such an impregnated wood composite, these resins tend to strengthen composite door materials by forming a three-dimensional crosslinked structure in and around the wood fibers. However, they do not form chemical bonds to the cellulose molecules of the lignocellulosic fibers, but instead they merely encapsulate the wood fibers in a physical net of crosslinked resin. Generally speaking, physical bonds, such as those just described, are much weaker than chemical bonds. Phenol-formaldehyde binder is additionally unsatisfactory because its crosslinking reaction proceeds at a relatively slow rate and requires a temperature in excess of 350° F.

Resin-impregnated substrates have in the past been disclosed but their manufacture has been undesirable because they required the use of a solvent or vapor recovery system, long cure times, and relatively high manufacturing costs due to oven curing. These efforts involving dry curing or curing that does not take place by application of a heated liquid, have also resulted in a surface appearance that is too glossy, cracked, marred, and/or is otherwise aesthetically displeasing. First, both fine and coarse, broken or unbroken bubbles are formed on the surface due to $CO_2$ escaping through a film of resin formed on the substrate surface, resulting in a rough, pitted and generally marred appearance. Second, the surface film of cured resin cures to a high gloss finish. Third, the resin film tends to pool and run before curing is completed, resulting in streaks, runs, and drips on the substrate surface.

Attempts to remove the high gloss, rough, pitted and marred surface film from the polyisocyanate-impregnated substrate have been unsuccessful because such efforts leave a rough, matte, highly textured surface having a wholly unsuitable aesthetic appearance. Additionally, if the substrates are molded or otherwise configured into a three dimensional pattern before impregnation, as is done for molded door skins, the three dimensional design or pattern on the cured, impregnated substrate is ruined if the oven-cured surface film is removed. This is because the fine details, lines, curves, ridges, and other three dimensional patterns are scraped, sanded, gouged, or otherwise worn down and marred as the surface film is removed.

Those skilled in the art will recognize that there is a need for a polyisocyanate-impregnated lignocellulosic substrate exhibiting suitable strength and water resistance so that it may be used for exterior applications. Yet a further need in the art is a method of manufacturing such polyisocyanate-impregnated lignocellulosic substrates, but without requiring expensive oven curing or additional surface processing. Yet a further need in the art is a system for producing such polyisocyanate-impregnated lignocellulosic substrates. The disclosed invention meets these and other needs in the art.

SUMMARY OF THE INVENTION

The invention is directed to a novel method of producing polyisocyanate-impregnated lignocellulosic substrates. This method is simpler, cheaper, faster, and more environmentally safe than the prior art methods used to produce polyisocyanate-impregnated lignocellulosic substrates. This method achieves these advantages because it does not require the use of a solvent, carrier, or vapor recovery system, or an oven for curing. The novel method also enables faster cures without requiring curing agents or accelerators.

Unexpectedly, the inventors have found that curing of an isocyanate resin that is impregnated into a lignocellulosic substrate may be completed more quickly, cheaply, and uniformly, while at the same time drastically reducing the amount of waste produced, if it is performed by applying a heated liquid onto the impregnated substrate, rather than curing the impregnated substrate in an oven. The inventors have also found that an isocyanate resin material may be impregnated more quickly, deeply and uniformly, if the resin-impregnated substrate is passed through an air knife system. The air knife system yields an important advantage in that a smoother, less glossy surface is obtained in the final product. More specifically, pre-configured door skins, rails, stiles, and cores may be treated according to the method of the present invention to render them aesthetically suitable for use in doors.

The invention is also directed to a polyisocyanate-impregnated lignocellulosic substrate whose surface is non-glossy, smooth, and satin-like. This novel article has increased strength, water resistance, fire resistance, insect resistance, and fungi resistance. More specifically, the inventive article has a surface whose appearance is aesthetically suitable for use in doors without requiring further processing, and does not exhibit the undesirable appearance produced by the prior art methods.

The invention is also directed to a novel system for performing the inventive method. This system is simpler, cheaper, and smaller than those conventionally used in the art, because polymerization is performed by applying a heated liquid to the resin-impregnated substrate, instead of requiring costly and spacious solvent removal components and ovens.

As used herein, the term, "polymerization", is used synonymously with the term, "curing", as understood in the art, and includes the formation of a polymer from monomers, dimers, or trimers.

Therefore, it is a primary object of the invention to provide a method for increasing the strength and water resistance of a substrate of a lignocellulosic material comprising the following steps. A substrate of a lignocellulosic material is impregnated with an isocyanate resin material. Excess isocyanate resin material is removed from the impregnated substrate by impinging air at a high flow rate upon the impregnated substrate. The resin is polymerized by applying a liquid to the impregnated substrate, the liquid being at a temperature sufficient for polymerization. Excess liquid is then removed from the polymerized resin-impregnated substrate.

It is another primary object of the invention to provide an article having increased strength and water resistance, the article comprising a substrate of a lignocellulosic material impregnated with a polyisocyanate material. The article has a smooth, low-gloss surface. The substrate comprises a lignocellulosic material.

It is yet another primary object of the invention to provide a system for forming a polyisocyanate-impregnated substrate, the system comprising an impregnation station for impregnating a substrate of a lignocellulosic material with an isocyanate resin material, a resin removal station for removing excess amounts of isocyanate resin material from the substrate, and a polymerization station for polymerizing the isocyanate resin material impregnated in the substrate. The impregnation station comprises a means for heating isocyanate resin material and a means for applying the heated isocyanate resin material to the impregnated substrate. The means for applying the heated isocyanate resin material is one of a first soaking tank and a plurality of nozzles. The resin removal station comprises an air knife station. The polymerization station comprises a means for heating a liquid and a means for applying the heated liquid to the impregnated substrate. The means for applying the heated liquid is one of a second soaking tank and a plurality of nozzles.

It is yet another primary object of the invention to provide a door having increased strength and water resistance. The door comprises a door frame having top and bottom rail members and first and second stiles oriented substantially parallel to one another, and two door skins disposed on opposing sides of the door frame. At least one of said door skins comprises a substrate of a lignocellulosic material impregnated with a polyisocyanate material. The at least one door skin has a smooth, non-glossy surface.

DETAILED DESCRIPTION

The inventors have found that by polymerizing an isocyanate resin-impregnated lignocellulosic substrate by applying a heated liquid to it, the product obtained not only has increased strength, water resistance, rot resistance, and termite resistance, as compared to the prior art, but it also has a smooth, relatively non-glossy, satin-like finish. The inventors have further found that by passing the isocyanate resin-impregnated lignocellulosic substrate through an air knife system, the resin may be impregnated more deeply and uniformly into the lignocellulosic substrate, while at the same time removing excess resin from the surface of the substrate.

The lignocellulosic substrate used to produce the inventive article is made of lignocellulosic material, i.e., material containing both cellulose and lignin. Often, such lignocellulosic material is in a fibrous form. Suitable lignocellulosic materials include wood particles, wood fibers, straw, hemp, sisal, cotton stalk, wheat, bamboo, jute, salt water reeds, palm fronds, flax, groundnut shells, hard woods, or soft woods, as well as fiberboards such as high density fiberboard, medium density fiberboard (MDF), oriented strand board and particle board. Although wheat straw and other bodies of annual plants contain some lignin, they are sometimes not referred to as lignocellulosic materials. However, for purposes of the present invention these annual plants are included within the term "lignocellulosic material". The lignocellulosic substrate is preferably medium density or high density fiberboard.

The lignocellulosic substrate may be molded or non-molded, and may be in the form of a strip, panel, block, sheet, veneer or the like. The lignocellulosic substrate is preferably suitable for use as a door or door component, including skins, cores, stiles, rails, moldings and the like.

Figure 1:
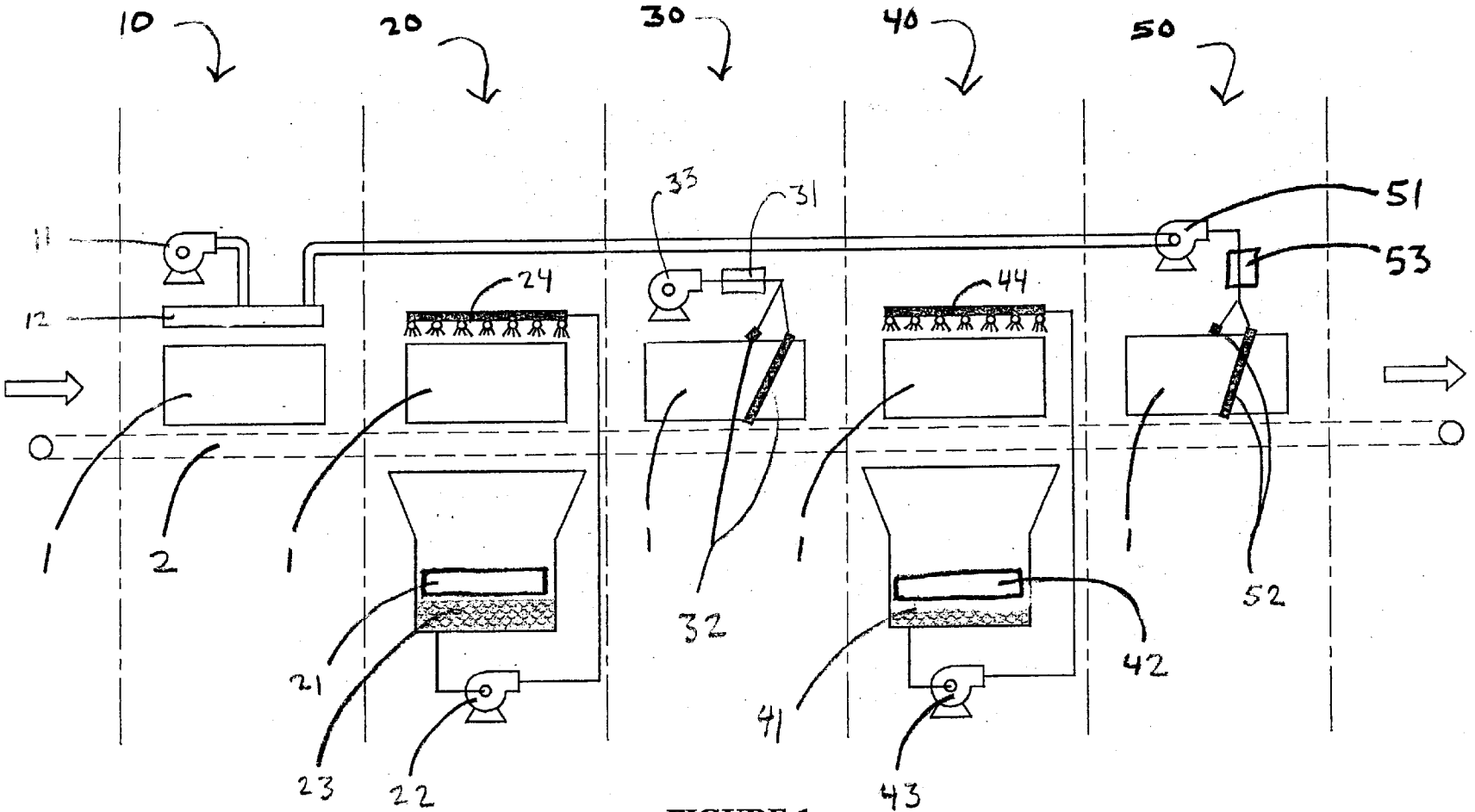
FIG. 1 is schematic view of the system of the present invention.

As best shown in FIG. 1, the lignocellulosic substrate 1 is dried at a dehydration station 10. Ordinarily, stock lignocellulosic substrates have a moisture content of about 3–8% by weight, but an even lower moisture content is important for achieving maximum strength and penetration by the isocyanate resin material. When methylene diphenyl diisocyanate (MDI) is used as the isocyanate resin material, water in the lignocellulosic material tends to react with the MDI to form a urea linkage. This urea linkage is weaker than that of the urethane linkage between the cellulose molecules and the polyisocyanate obtained after polymerizing the isocyanate resin material, thus it reduces the overall potential strength of the final product, as compared to a drier substrate 1 treated according to the method. For each gram of water removed from the lignocellulosic substrate 1, approximately one gram of isocyanate resin will replace it in the polyisocyanate-impregnated lignocellulosic substrate 1. Preferably, the dehydration step results in a lignocellulosic substrate 1 with a moisture content of less than 7% by weight, and more preferably about 0.1–2.5% by weight.

In order to achieve the desired level of moisture content in the lignocellulose substrate 1, the substrate 1 is transported by a conveyor system 2 to a dehydration station 10. The substrate 1 is dried by heated air from a first blower 11 and a first heater 12 set between 200° F. and 300° F. The heated air exiting the dehydration station 10 is diverted to a second blower 51 for post-impregnation drying at station 50. Although a blower and heater combination is preferred in this embodiment, the substrate 1 may alternatively be dried by a catalytic infra-red heater designed to achieve up to a 350° F. surface temperature on the lignocellulosic substrate 1.

Next, the dried lignocellulosic substrate 1 is impregnated with an isocyanate resin material at an impregnation station 20. At impregnation station 20, isocyanate resin material is heated by a resin heater 21 and transported by a pump 22 from a first reservoir 23 to a series of applicator nozzles 24, where the resin material is applied to, and impregnated into, the dried substrate 1. Excess resin material is collected in the first reservoir 23 below the applicator nozzles 24 and subsequently reused. The reservoir and pumping system allows isocyanate resin material to be continuously reapplied to the substrate 1, thus shortening the impregnation time and preventing waste of the isocyanate resin material. Isocyanate resin material is allowed to contact the surfaces of the substrate 1 for preferably 4–10 minutes, and more preferably for 4 minutes.

Instead of employing applicator nozzles 24, the dried substrate 1 may alternatively be impregnated by soaking it in a soaking tank filled with heated resin material. If soaking is chosen for performing the impregnation step, lignocellulosic substrates 1 inside the soaking tank are preferably kept submerged for 4–10 minutes to insure full penetration of the isocyanate resin, but the actual soak time will depend upon the thickness and density of the substrate 1. The tank is preferably maintained at atmospheric pressure, but a pressurized soak tank may be used in order to shorten the soak time for thicker or denser substrates 1. When the tank is not in use, a dry inert gas at atmospheric pressure and room temperature is applied to the headspace to extend the resin's pot life.

Whether application by a series of nozzles or by soaking is chosen, the degree of impregnation of the isocyanate resin material into the lignocellulosic substrate 1 is believed to be at least partly governed by the viscosity and temperature of the isocyanate resin material, and the length of time and pressure at which the resin material is applied to the substrate 1. For example, an isocyanate resin material having a lower viscosity or one being maintained at a higher temperature will be impregnated into the substrate 1 more quickly than one having a higher viscosity or one being maintained at a lower temperature. Similarly, a higher pressure or longer application time will result in greater impregnation than a lower pressure or shorter application time. If MDI is chosen for the isocyanate resin material, viscosities for MDI products (in Centipoise) at various temperatures may be found in Table I.

TABLE I

| | Viscosity (in Centipoise) of various MDI products at different temperatures | | |
|---|---|---|---|
| MDI Product | 25° C. (77° F.) | 50° C. (122° F.) | 60° C. (140° F.) |
| Lupranate M-20 S (BASF) | 200 | | 25 |
| Elastocast 7034 U (BASF) | 700 | 96 | 58 |
| WUC 3092 T (BASF) | 700 | 128 | |
| Desmodur VKS-18 (Bayer) | 150–250 | | |
| E-743 (Bayer) | 1700–3300 | | |
| X0672 (Bayer) | 300–800 | | |

During the impregnation step, the isocyanate resin material reacts with the wood cellulose. It is believed that the isocyanate forms a chemical bond between the hydroxyl groups of the wood cellulose, thus forming a urethane linkage. It is further believed that this chemical bond contributes to the improved strength of the final product. It is further believed that the isocyanate resin molecules, whether bonded to cellulose molecules or not, do not polymerize to any significant extent during the impregnation step.

The isocyanate resin material is preferably an MDI material. The structure of MDI is depicted by formula I below. More preferably, the isocyanate resin material contains 4,4'-methylene diphenyl diisocyanate, where Ph is a phenyl group.

$$O{=}C{=}N{-}Ph{-}CH_2{-}Ph{-}N{=}C{=}O \qquad \text{Formula I}$$

Generally speaking, commercial preparations of the isocyanate resin material contain not only 4,4'-methylene diphenyl diisocyanate, but also poly(methylene diphenyl diisocyanate) otherwise known as polymeric MDI (or PMDI), mixed methylene diphenyl diisocyanate isomers, and 2,4'-methylene diphenyl diisocyanate. If methylene diphenyl diisocyanate resin material is chosen for the isocyanate resin material, it preferably has a content of about 33% to about 49% of 4,4'-methylene diphenyl diisocyanate, less than about 70% of poly(methylene diphenyl diisocyanate), less than about 10% of mixed methylene diphenyl diisocyanate isomers, and less than about 8% of 2,4'-methylene diphenyl diisocyanate. Most preferably, the MDI employed in the invention will have about 45% methylene diphenyl diisocyanate, with the balance being poly (methylene diphenyl diisocyanate).

The MDI material should have high —N═C═O content, preferably an —N═C═O content of greater than 33% (by wt.), more preferably 1–33% (by wt.), even more preferably 10–33% (by wt.), and most preferably 23–32% (by wt.). The MDI material will preferably have a high —N=C=O functionality, more preferably from 2 to 3, most preferably closer to 3 than 2. The MDI material will preferably have a viscosity of 50–300 Centipoise (at 25° C.), more preferably closer to 50 than 300. If desired, the MDI material may be used in combination with a non-polar solvent in a proportions of 10–100% (by wt.) of MDI and 0–90% (by wt.) of non-polar solvent.

The isocyanate resin material may also include a preservative, such as a bactericide, fungicide or insecticide or the like, preferably in an amount of from 0.25% to 10% by weight of the resin material. Examples of such biocides are complexes of boron, atrazines, thiazoles and carbamates. The isocyanate resin material may also include other additives such as fire or flame retardant chemicals, including but not limited to tris(1,3-dichloroisopropyl)phosphates, or dimethyl methalphosphenate. These fire or flame retardants may comprise from 0.25% to 5.00% by weight of the resin material.

Next, at resin removal station 30, excess resin is removed from the surface of the impregnated substrate 1 and the chemical reaction between the isocyanate and cellulose molecules is accelerated by an elevated temperature. In addition to resin removal at station 30, impregnated resin is also heated to the elevated temperature of 240–300° F. and forced toward the middle of the substrate 1. The chemical reaction between the isocyanate resin and the cellulose molecules begins at temperatures as low as 212° F. At the resin removal station 30, the impregnated substrate 1 is passed by a first air knife set 32. At the air knife set 32, heated air from a heater 31 is directed onto surfaces of the substrate 1 by a blower 33. The air knife set 32 itself is a pair of long tubes each having a long slit for egress of heated air at an elevated pressure onto the surfaces of the impregnated substrate 1. While the air flow, velocity and temperature through the air knife set 32 may be varied, the air flow, velocity and temperature are preferably maintained at about 800 $ft^3$/min, about 15,000–35,000 ft/min, and about 240–300° F., respectively. As heated air impinges upon the surface of the impregnated substrate 1 from the air knives, some of the excess resin not fully impregnated into the substrate 1 is forced further into the substrate 1, while the remainder is blown off, thereby preventing a film or skin of resin material from forming on the substrate 1 surface.

Next, the impregnated isocyanate resin material is polymerized at a polymerization station 40 by applying a liquid to the impregnated substrate 1 at a temperature sufficient for polymerization of the isocyanate material. The liquid is contained in a second reservoir 41, where it is heated by a heater 42, pumped by a pump 43, and applied to the impregnated substrate 1 by applicator nozzles 44. Surfaces of the impregnated substrate 1 will cure to a darker appearance if they are not covered with the heated liquid, so it is preferable to ensure full coverage of all the surfaces with the heated liquid. The flow of liquid through the nozzles 44 is preferably maintained at about 5–10 gpm at a pressure of 5–6 psi. After flowing off the surfaces of the impregnated substrate 1, the heated liquid is collected in the second reservoir 41 where it may be reused.

Suitable liquids include those materials that exist in a liquid form (under atmospheric pressure) at the polymerization temperature of the isocyanate resin material, and which also do not substantially inhibit the polymerization reaction. The liquid is preferably reactive toward the isocyanate resin material, thus forming reaction products at the surface of the substrate 1. The liquid is selected so that the reaction products between it and the resin may be more easily removed from the surface of the substrate 1, than compared to polymerized isocyanate resin at the surface of the substrate 1. For example, if water and MDI are selected as the liquid and isocyanate resin, they react to form water soluble materials containing urea linkages. Because the reaction products formed at the surface of the substrate 1 are soluble in the liquid, the resultant appearance of the treated surface of the substrate 1 is that of a smooth, satin-like and relatively non-glossy board. A preferred liquid is water. The liquid may be maintained at a temperature of equal to or greater than 180° F., preferably at between 180° F. and 212° F., and most preferably at about 180° F. The liquid may be applied to the impregnated substrate 1 for a period of 8–10 minutes, but shorter or longer times may be selected depending upon the thickness of the lignocellulosic substrate 1.

Reaction products may result from a reaction between the heated liquid and the isocyanate resin material, and will gradually build up in the second reservoir 41 along with fibers from the lignocellulosic substrate 1. As the reaction product builds up, it may be removed by filtering liquid in second reservoir 41. A hot liquid make-up source 45 supplies fresh liquid to second reservoir 41 to replace liquid diminished through evaporation and filtration.

Alternatively, the resin in the impregnated substrate 1 may be polymerized by soaking the impregnated substrate 1 in heated liquid inside a soaking tank equipped with a circulation pump and a heater.

Next, excess liquid is removed from the polyisocyanate-impregnated substrate 1 at a liquid removal station 50. This is accomplished by the use of a second air knife set 52 (also including a heater 53 and blower 51) maintained at the same air flow and temperature as the first set of air knives 32. As heated air impinges upon the surface of the substrate 1 from the air knife, excess liquid and any resin-liquid reaction product formed at the surface of the substrate 1 are blown off the substrate 1.

Alternatively, the liquid removal step may be performed by merely 11 removing the polyisocyanate-impregnated substrate 1 from the liquid and allowing the liquid to drain.

Alternatively, the polyisocyanate-impregnated substrate 1 may be dried for about 10 minutes in an oven set at 200° F.–300° F.

In any case, a moisture content of less than 10% is preferred.

Figure 2:
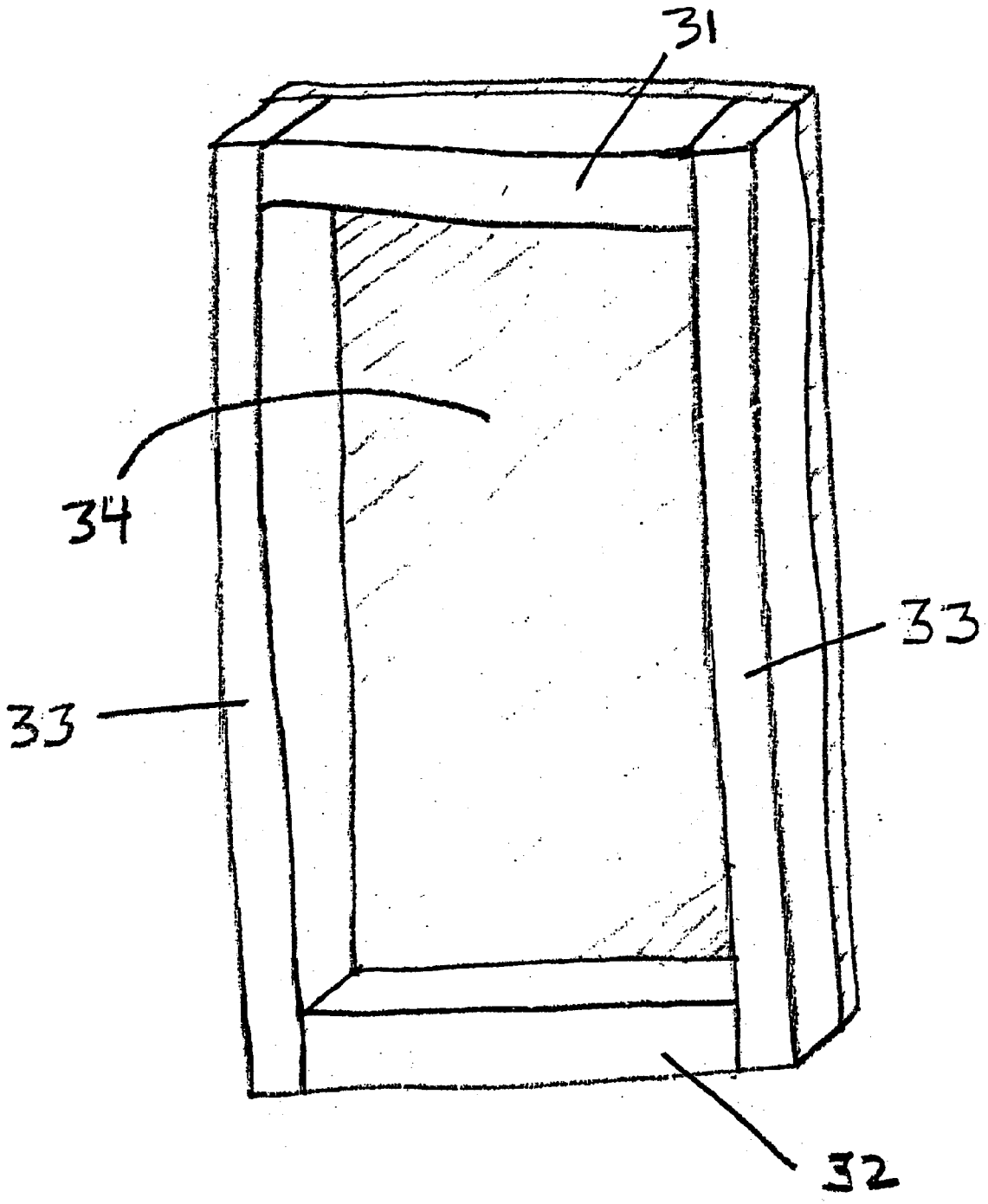
FIG. 2 is a perspective view of the door of the present invention with one door skin removed.
Figure 1:
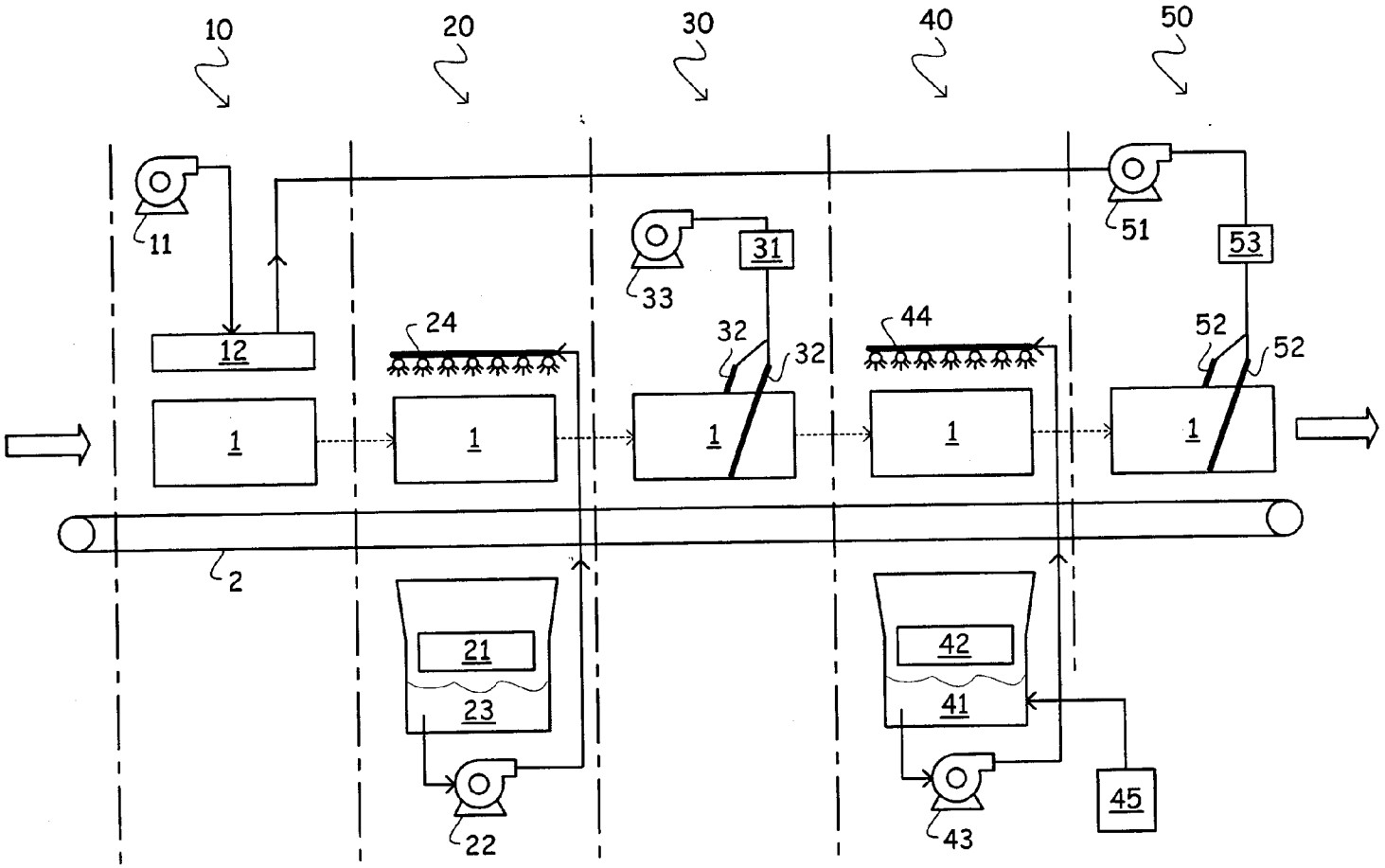
Figure 2:
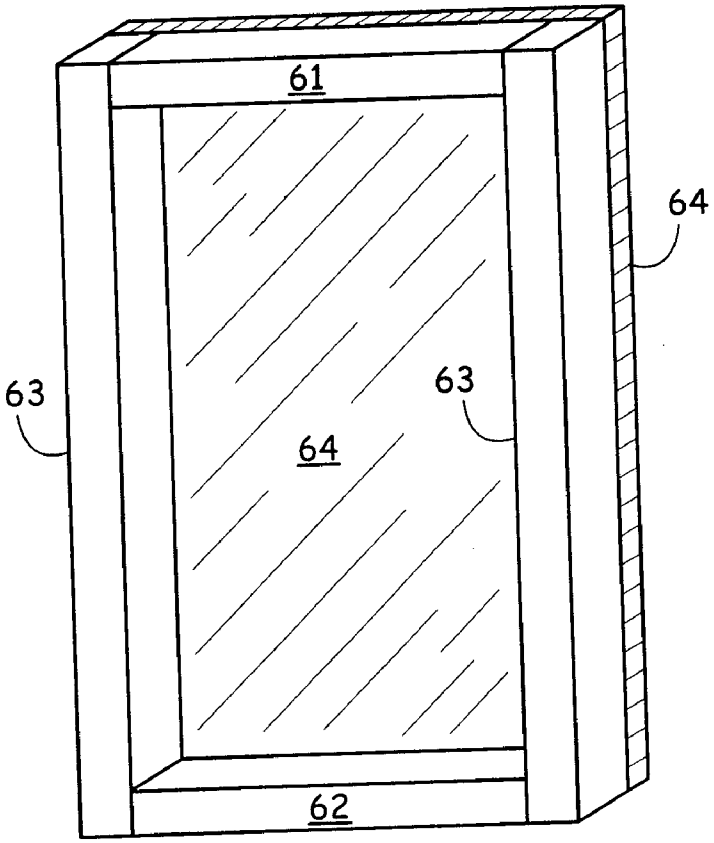

As shown in FIG. 2, the inventive door has a top rail 61, a bottom rail 62, and two stiles 63 forming a door frame, as well as two door skins 64 disposed on opposite sides of the door frame (one door skin has been removed to clarify door structure). It is understood that the door skins do not have to be planar, but may be formed according to any three-dimensional molded shape.

The inventive article's increased strength is believed to be due to some or all of the following factors: a) urethane linkages between —OH groups on the cellulose molecules of the lignocellulose fibers and —N═C═O groups on the isocyanate resin, b) urea linkages formed by the reaction of water bound in the lignocellulose fibers and —N═C═O groups of the excess isocyanate resin, c) a polyurethane chain formed by polymerization of the isocyanate resin, d) a polyurea chain formed by polymerization of the reaction product of bound water and excess isocyanate resin, e) encapsulation of the lignocellulose fibers by the polyurea chains as described in above, f) encapsulation of the lignocellulose fibers by the polyrethane chain formed by polymerization of the isocyanate resin, g) crosslinking of the polyisocyanate chains.

The polyisocyanate-impregnated substrate of the present invention ordinarily will contain 0.5–20%, preferably 2.0–15%, more preferably 5.0–10%, and most preferably 7.0–8.0% polyisocyanate by weight.

EXAMPLES

The performance of six different PMDI formulas was compared by treating door skin and door rail/stile material with PMDI. The PMDI formulas are available under the following trade names: 1) Lupranate M20S (BASF); 2) Elastocast 7034U (BASF); 3) WUC 3092 T (BASF); 4) Desmodur VKS-18 (Bayer); 5) E-743 (Bayer); and 6) X0672 (Bayer).

Each of the formulas is a blend of the following ingredients: 33–49% of 4,4' diphenylmethane diisocyanate, <70% of polymeric MDI, <10% of mixed isomers of MDI, and <8% of 2,4' diphenylmethane diisocyanate. The formulas have properties in the following ranges: a specific gravity of 1.08–1.24 (g/cm$^3$ at 25° C.), a density of 9.0–10.3 (lbs/gal), a viscosity of 200–3300 (centipoise at 25° C.), an NCO content of 23–31.5% (by wt.), and a functionality of 2.7.

The door skin and door rail/stile materials were treated as follows.

The door stile/rail material was one-inch thick, 44 pound medium density fiberboard manufactured by Temple. Test samples labeled "B were cut into pieces 6 inches long by 1&½ inches wide. The test samples labeled "A" were machined to a shape suitable for metal door applications and then cut to 6 inch lengths. The cross section of samples "A" was ⅞ inches by 1&⅝ inches. A pilot hole having a 0.120 inch diameter was drilled through each piece of the door stile/rail material. A 100% impregnation was not expected of the door stile/rail material. The predrilled pilot hole provides a means to extend the PMDI treatment into the screw holding area of the stile. The benefit of the predrilled pilot hole may be seen in Table II.

The door skin material was high density fiberboard manufactured by Fibramold in Chile. The door skin material was labeled as samples "C" and "D". The door skin material was 0.125 inches thick and cut to 3&¾ inches by 5&¾ inch samples.

Each of the PMDI formulas was used to impregnate a pair of the door skin pieces and a pair of the door rail/stile pieces.

The pieces were submerged for ten minutes while the PMDI formulas were maintained at a temperature of 150° F. After impregnation, the pieces were heated 10 minutes in a 200° F. oven and the excess PMDI wiped off. The pieces were then stored at room temperature for 18 hours. After storage, the pieces were again weighed, and cured by submerging them in 180° F. water for 10 minutes. After drying the pieces for 10 minutes in a 200° F. oven (to reduce the moisture content to less then 10% by weight), they were weighed again.

The MDI Uptake value (in g/g) was obtained by dividing the weight of MDI impregnated into the test example by the weight of the untreated test example, and multiplying by 100%. The results are tabulated in Table II.

The ability of the inventive article to hold wood screws was then tested against a comparative example, CE 1. Comparative example CE 1 is a medium density fiberboard available under the trade name Medite FR (manufactured by Medex). The Medite FR is a fire-rated fiberboard advertised by Medex as "the world's finest exterior grade formaldehyde-free MDF".

A pair of ¾ inch #8 wood screws were then screwed into the door rail/stile material test examples (1A, 1B, 2A, 2B, etc.). One of the wood screws was screwed in the pilot hole while the other screw was screwed in an area other than the pilot hole. A single ¾ inch #8 wood screw was inserted into comparative example CE 1.

Dimensional expansion due to water absorption was also tested for test example 1B (door stile/rail material impregnated with Lupranate M20S) and comparative example CE 1. As such, the initial dimensions (width, length and thickness) of test example 1B and comparative example CE 1, as well as the weight of CE 1, were recorded.

Comparative example CE 1 and all of the door rail/stile material test examples (1A, 1B, 2A, 2B, etc.) were then placed in boiling water for one hour and their weights recorded.

The % Water Gain (in grams) for each test example and comparative example CE 1 was calculated by dividing the weight of water gained by the examples due to the boil by the weight of the example before the boil, and multiplying by 100%. The results are tabulated in Table II.

All of the test examples and comparative example CE 1 were then dried in a 200° F. oven for 18 hours. The dimensions of test example 1B and comparative example CE 1 were recorded again. Each of the wood screws was removed, and the force (in p.s.i.) that is required to remove it was recorded. The results are tabulated in Table II.

The % Expansion for each of length, width, and thickness was calculated by dividing the change in the particular dimension (whether after the change after boiling, or the change after both boiling and drying) by the initial dimension and multiplying by 100%. The results are tabulated in Tables III and IV.

TABLE II

% Water Gain, Screw Pull Force, and PMDI Uptake

| Isocyanate Resin Formula | Example # | % Water Gain | Screw Pull Force, Predrilled (p.s.i.) | Screw Pull Force, Not Predrilled (p.s.i.) | PMDI Uptake (g/g) |
|---|---|---|---|---|---|
| Lupranate | 1A | 3.01 | 507.0 | 310.1 | .169 |
| | 1B | 1.58 | 689.5 | 324.5 | .138 |

TABLE II-continued

% Water Gain, Screw Pull Force, and PMDI Uptake

| Isocyanate Resin Formula | Example # | % Water Gain | Screw Pull Force, Predrilled (p.s.i.) | Screw Pull Force, Not Predrilled (p.s.i.) | PMDI Uptake (g/g) |
|---|---|---|---|---|---|
| | 1D | | | | .155 |
| Elastocast | 2A | 2.6 | 567.8 | 331.2 | .169 |
| | 2B | 1.7 | 703.0 | 351.5 | .146 |
| | 2C | | | | .134 |
| WUC 3092T | 3A | 4.45 | 527.3 | 358.3 | .148 |
| | 3B | 2.76 | 594.9 | 338.0 | .111 |
| | 3C | | | | .133 |
| Desmodur | 4A | 3.41 | 561.1 | 358.3 | .161 |
| | 4B | 2.12 | 500.2 | 365.1 | .135 |
| | 4C | | | | .149 |
| E-743 | 5A | 4.15 | 405.6 | 324.5 | .108 |
| | 5B | 3.07 | 432.6 | 311.0 | .072 |
| | 5C | | | | .090 |
| X 0672 | 6A | 3.06 | 419.1 | 324.5 | .126 |
| | 6B | 2.29 | 554.3 | 297.4 | .090 |
| | 6C | | | | .130 |
| Medex Medite FR | CE 1 | 32.57 | | 338.0 | |

TABLE III

Dimensional Expansion of Test Example 1B*

| | Initial value | Value, 1 hr. boil | % Change after boiling | Value, dried | % Change after boiling & drying |
|---|---|---|---|---|---|
| Length (in.) | 5.987 | 5.998 | +1.10 | 5.980 | −0.12 |
| Width predried (in.) | 1.505 | 1.505 | 0.00 | 1.505 | 0.00 |
| Width wet (in.) | 1.505 | 1.514 | +0.60 | 1.505 | 0.00 |
| Thick. predried (in.) | 1.005 | 1.014 | +.90 | 0.995 | −0.40 |
| Thick. wet (in.) | 1.010 | 1.072 | +6.14 | 1.025 | +1.49 |
| Visual assessment | | Excellent, no deformation | | | |

*Example 1B is medium density fiberboard impregnated with Lupranate M20S.

TABLE IV

Dimensional Expansion of Comparative Example CE 1*

| | Initial value | Value, 1 hr. boil | % Change after boiling | Value, dried | % Change after boiling & drying |
|---|---|---|---|---|---|
| Length (in.) | 5.976 | 6.015 | +0.65 | 5.960 | −0.27 |
| Width, predried (in.) | 1.523 | 1.535 | 0.79 | 1.520 | −0.20 |
| Width, wet (in.) | 1.529 | 1.550 | +1.37 | 1.527 | −0.13 |
| Thickness, predried (in.) | .765 | 0.880 | +15.03 | 0.807 | +5.49 |
| Thickness, wet (in.) | .757 | .950 | +25.50 | 0.874 | +15.46 |
| Visual assessment | | Poor: edges swollen & center cupped | | Poor: cracked & cupped | |

*Comparative example CE 1 is a Medex Medit FR fiberboard.

Further water absorption properties were evaluated for the invention (test example 7) and two comparative examples CE 2 and CE 3.

Test examples 7 utilized medium density fiberboard as the substrate material. Masonite fiberboard was employed for comparative example CE 2, while Medex Medite FR fiberboard was used for comparative example CE 3.

Test example 7 was impregnated with PMDI, dried, stored, cured and dried again as described above for test examples 1A through 6D. The weight, length and thickness of test example 7 and comparative examples CE 2 and CE 3 were recorded. Test example 7 and comparative examples CE 2 and CE 3 were then submerged in water for 24 hours. The weight, length and thickness were again recorded after submerging.

The % water absorption was calculated by dividing the change in weight due to the 24 hour soak by the initial weight. Similarly, the % thickness swell was calculated by dividing the change in thickness due to the 24 hour soak by the initial weight, and the % linear expansion was calculated by dividing the change in length due to the 24 hour soak by the initial thickness. The results of the % water absorption, % thickness swell and % linear expansion are tabulated in Table V.

A thermal decomposition test was performed as well. As in the water absorption test, test example 8 utilized medium density fiberboard, comparative example CE 4 was a Masonite fiberboard, and comparative example CE 5 was a Medex Medit FR fiberboard. Test example 7B and comparative examples CE 4 and CE 5 were exposed to a temperature of 950° F. and observations were made at 3.5 minutes, 15 minutes and 30 minutes. The results are tabulated in Table VI.

TABLE V

Percent Water Absorption, Thickness Swell, and Linear Expansion

| | CE 2 (Masonite) | CE 3 (Medex Medite FR) | Test Example 7 (MDF treated with PMDI) |
|---|---|---|---|
| % Water absorption | 15 | 52 | 12 |
| % Thickness swell | 15 | 20 | 11 |
| % Linear expansion | 1.4 | 0.8 | 0.2 |

TABLE VI

Thermal Decomposition Test

| | CE 4 (Masonite) | CE 5 (Medex Medite FR) | Test Example 8 (MDF treated with PMDI) |
|---|---|---|---|
| Appearance after 3.5 minutes | – | + | + |
| Appearance after 15 minutes | | – | + |
| Appearance after 30 minutes | | | = |

+ Indicates the absence of visible red embers at edges and absence of ply separation
= Indicates the presence of visible red embers at edges, but no ply separation
– Indicates either the presence of visible red embers at edges or ply separation with the surface layers broken into small curved segments The invention was further tested for both insect and fungi resistance. Portions of medium density fiberboard were treated with PMDI in accordance with the invention to provide test examples 9 and 10. Test example 9, along with comparative examples CE 6 of white pine and CE 7 of untreated MDF, were exposed to subterranean termites and powder post beetles. Test example 10 and comparative examples CE 8 of white pine and CE 9 of untreated MDF were exposed to brown-rot decay and white-rot decay. In all instances, test examples 9 and 10 performed as well as, or better than, both white pine and untreated MDF.

While this invention has been described as having a preferred design, it is understood that it is capable of further modifications, uses, and/or adaptations following in general the principle of the invention and including such departures from the present disclosure as come within known or customary practice in the art to which the invention pertains, and as may be applied to the essential features set forth herein, and fall within the scope of the invention limited by the appended claims.

What we claim is:

1. A method for increasing the strength and water resistance of a substrate of a lignocellulosic-material, comprising the steps of:

impregnating a substrate of a lignocellulosic material with an isocyanate resin material;

removing excess isocyanate resin material from the impregnated substrate by impinging air at a high flow rate upon the impregnated substrate;

polymerizing the resin by applying water to the impregnated substrate, the water being at a temperature sufficient for polymerization; and removing the water from the polymerized resin-impregnated substrate.

2. The method of claim 1, including the step of selecting an air knife system for providing the high flow rate of impinging air upon the impregnated substrate.

3. The method of claim 1, including the step of selecting the substrate from lignocellulosic fibers and binder.

4. The method of claim 3, including the step of selecting the binder from urea-formaldehyde resin or phenol-formaldehyde resin.

5. The method of claim 1, including the step of maintaining the liquid at a temperature greater than or equal to about 180° F.

6. The method of claim 1, including the step of maintaining the water at a temperature in the range of about 180° F. to about 212° F.

7. The method of claim 1, including the step of maintaining the water at a temperature of about 180° F.

8. The method of claim 1, including the step of dehydrating the substrate in an oven before impregnation until a moisture content of less than about 7% by weight is achieved.

9. The method of claim 1, wherein said applying is achieved by applying a plurality of streams of water to the substrate of a lignocellulosic material.

10. The method of claim 1, including the step of maintaining the pressure of the isocyanate resin material impregnate at about 1 atmosphere.

11. The method of claim 1, including the step of maintaining the isocyanate resin material at a temperature of about 150° F.

12. The method of claim 1, including the step of selecting the isocyanate resin material from methylene diphenyl diisocyanate resin material.

13. The method of claim 1, including the step of selecting the isocyanate resin material from methylene diphenyl diisocyanate resin material, said methylene diphenyl diisocyanate resin material having a content of about 33% to about 49% of 4,4'-methylene diphenyl diisocyanate, less than about 70% of poly(methylene diphenyl diisocyanate), less than about 10% of mixed methylene diphenyl diisocyanate isomers, and less than about 8% of 2,4'-methylene diphenyl diisocyanate.

14. The method of claim 1, further comprising the step of selecting the isocyanate resin material from those having an —N═C═O content in a range of about 1% to about 33% by weight of the isocyanate resin material.

15. The method of claim 1, further comprising the step of selecting the isocyanate resin material from those having an —N═C═O content of about 10% to about 33% by weight of the isocyanate resin material.

16. The method of claim 1, further comprising the step of selecting the isocyanate resin material from those having an —N═C═O content of about 23% to about 32% by weight of the isocyanate resin material.

17. The method of claim 1, further comprising the step of selecting the isocyanate resin material from those having a —N═C═O functionality of about 2 to about 3.

18. The method of claim 1, further comprising the step of selecting the isocyanate resin from those having a viscosity at 25° C. of about 50 to about 300 Centipoise.

19. The method of claim 1, further comprising the step of selecting the lignocellulosic material from either high density fiberboard, medium density fiberboard, oriented strand board, particle board, hemp, sisal, cotton stalk, wheat, straw, bamboo, jute, salt water reeds, palm fronds, flax, groundnut shells, hard woods, or soft woods.

20. The method of claim 1, further comprising the step of selecting the lignocellulosic material from medium density fiberboard.

21. A method for increasing the strength and water resistance of a substrate of a lignocellulosic material, comprising the steps of:

impregnating a substrate of a lignocellulosic material with an isocyanate resin material;

polymerizing the resin by applying water to the impregnated substrate, the water being at a temperature sufficient for polymerization; and removing the water from the polymerized resin-impregnated substrate.

* * * * *

UNITED STATES PATENT AND TRADEMARK OFFICE

CERTIFICATE OF CORRECTION

PATENT NO. : 6,620,459 B2
DATED : September 16, 2003
INVENTOR(S) : John Colvin et al.

It is certified that error appears in the above-identified patent and that said Letters Patent is hereby corrected as shown below:

Drawings,
Replace Figures 1 and 2, with the attached:

Column 1,
Lines 1-3, the title, "RESIN-IMPREGNATED SUBSTRATE, METHOD OF MANUFACTURE AND SYSTEM THEREFOR" should read -- METHOD FOR IMPREGNATING A SUBSTRATE WITH RESIN --.

Column 7,
Line 63, after the word "merely" and before the word "removing," delete -- 11 --.

Signed and Sealed this

Twenty-third Day of March, 2004

JON W. DUDAS
*Acting Director of the United States Patent and Trademark Office*